United States Patent [19]

Mandavi

[11] Patent Number: 4,974,991

[45] Date of Patent: Dec. 4, 1990

[54] VEHICLE SPEED BUMP DEVICE

[76] Inventor: Seid Mandavi, 4735 Sepulveda Ave., Sherman Oaks, Calif. 91403

[21] Appl. No.: 368,464

[22] Filed: Jun. 19, 1989

[51] Int. Cl.[5] ..... E01F 13/00

[52] U.S. Cl. ..... 404/6; 49/49; 404/11

[58] Field of Search ..... 404/6, 9, 11, 15; 49/49, 131

[56] References Cited

U.S. PATENT DOCUMENTS

| | | | |
|---|---|---|---|
| 2,105,857 | 1/1938 | Derby | 404/11 |
| 2,176,285 | 10/1939 | Whiting | 404/11 |
| 2,519,145 | 8/1950 | Manly | 404/11 |
| 3,720,181 | 3/1973 | Elkins | 116/63 P |
| 4,012,156 | 3/1977 | Turner et al. | 404/15 |
| 4,203,685 | 5/1980 | Snachez | 404/6 |
| 4,342,525 | 8/1982 | Mastronuzzi, Jr. | 404/6 |
| 4,362,424 | 12/1982 | Barber | 404/6 |
| 4,490,068 | 12/1984 | Dickinson | 404/6 |
| 4,627,763 | 12/1986 | Ruemer et al. | 404/6 |
| 4,687,370 | 8/1987 | Knowles | 404/15 |
| 4,697,294 | 10/1987 | Schafer | 14/69.5 |

*Primary Examiner*—William P. Neuder

[57] ABSTRACT

The present vehicle speed bump device allows a vehicle to roll over the device slowly with little resistance. However, the device includes a lock which operates to lock the speed bump of the device in operative position when contacted by a vehicle wheel moving at a higher speed, thereby causing an appreciable bump effect. The device includes a frame having a transverse bump bar at its upper end and a counterweight bar at its lower end. The frame is rotatably mounted by transverse axles secured to opposite sides of an open-topped container. In the resting position, the bump bar projects up above the open top. A lock arm projects rearwardly from and is rigidly interconnected to the frame for rotation therewith. It bears a vertical pendulum arm which rotates forwardly and rearwardly and which has a friction block at its lower end. A second friction block is mounted in the container below and to the rear of the first friction block. The two blocks contact and lock together to prevent continued rotation of the frame only when the bump bar is struck with sufficient force by a fast traveling vehicle wheel to swing the first friction block into the second block as the frame rotates. As a result the bump bar remains up above the container to transmit a large bump to the vehicle, the frame being locked in place.

11 Claims, 2 Drawing Sheets

VEHICLE SPEED BUMP DEVICE

BACKGROUND OF THE INVENTION

1. Field of the Invention

The present invention generally relates to vehicle speed control means and more particularly to an improved vehicle speed bump device.

2. Prior Art

Speed bumps are frequently embedded in roadways, such as in access lanes to and from residential and school areas, parking lots and the like so as to discourage or prevent the use of vehicles at high speed. Most such speed bumps are merely spaced rubber, steel or concrete bars or the like connected to the top of the road surface and, accordingly, are severly subject to wear. Moreover, they do not retract, so that even slow moving vehicles are jolted by passing over the bumps. See, for example, the speed bumps of U.S. Pat. Nos. 4,203,685, 4,697,294, 4,687,370, 4,362,424 and 3,720,181, some of which are of improved design but generally of the same basic type.

Certain other speed bumps have been devised, which bumps can be retracted or raised, as needed, either by a tool (see U.S. Pat. No. 4,012,156) or by a remotely operated hydraulic ram (see U.S. Pat. Nos. 4,342,525 and 4,490,068), the latter being expensive and complicated. However, none of such devices permit slow moving vehicles to pass thereover without a bump and simultaneously cause fast moving vehicles passing thereover to encounter a bump, in a cost-efficient manner.

Accordingly, there remains a need for an improved speed bump which can simultaneously allow slow moving vehicles to pass thereover smoothly without a bump but causes rapidly moving vehicles to suffer a bump. Such device should be simple, inexpensive, and durable, and require no periodic adjustments or repair. Such device would encourage the steady smooth flow of slow moving traffic.

SUMMARY OF THE INVENTION

The improved vehicle speed bump device of the present invention satisfies all the foregoing needs. The device is substantially as set forth in the Abstract of the Disclosure.

Thus, the device comprises an open-topped container adapted to be set into a roadway and in which is rotatably secured a frame having a transverse speed bump bar at its upper end and a counterweight at its lower end, the latter rotation of the speed bump bar into a resting position above the container top. The frame rotates forwardly and rearwardly around a transverse axis in the container.

A frame lock is secured to the frame in the container. It comprises a fixed lock arm extending rearwardly of the frame for rotation therewith, and a vertical pendulum connected to and depending from the lock arm and bearing a first triangular friction block on the lower end thereof. The pendulum arm can swing freely rearwardly and forwardly in the container. A second triangular friction block is mounted below and behind the first friction block in the container.

When a vehicle wheel passes over the device from front to rear, the bump bar is contacted and moves down and rearwardly as the frame is caused to rotate. If the vehicle wheel is going slowly enough, the frame rotation continues until the bump bar passes below the top of the container and the vehicle passes smoothly over the device without suffering a bump.

However, if the vehicle wheel strikes the bump bar at a higher speed, rotation of the frame from the vehicle wheel through the frame and lock arm the pendulum, causing it to swing rearwardly so that as the frame rotates, the first friction block engages the second friction block and locks the frame against further rotation, causing the bump bar to remain above the container and the vehicle to experience a definite bump or jolt when striking and riding over it.

Since the lock is automatic and powered solely by the force transmitted from the vehicle wheel, it requires no other source of power and need not be adjusted. Since the bump bar rotates down out of the vehicle's way, except in the case of encounters with rapidly moving vehicles, it suffers less wear than conventional speed bump bars and lasts longer.

Accordingly, the present device, which can be fabricated of conventional materials, has improved properties over conventional speed bumps. Further features of the speed bump of the present invention are set forth in the following detailed description and accompanying drawings.

DRAWINGS

DETAILED DESCRIPTION

FIGS. 1 & 2

Figure 1:
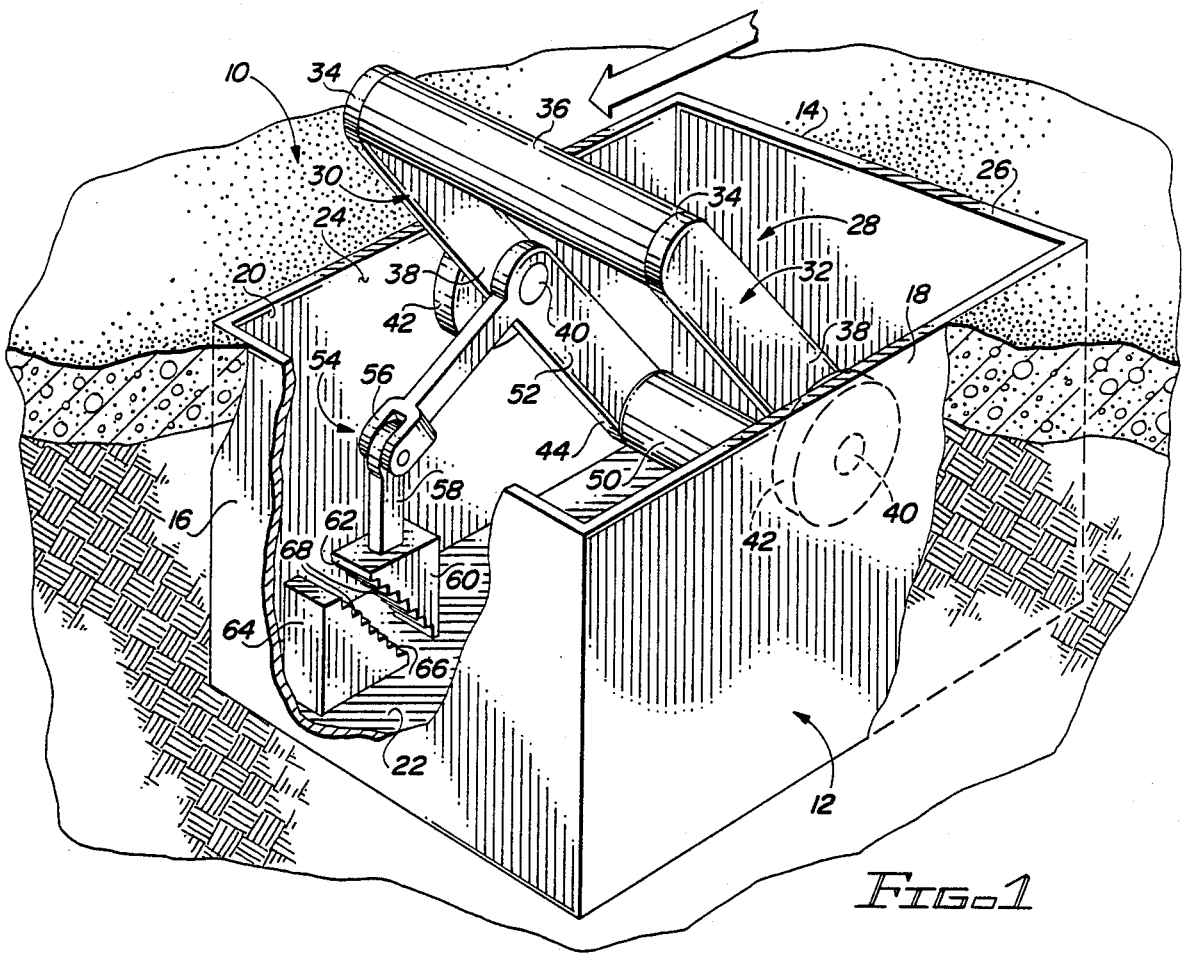
FIG. 1 is a schematic side perspective view of a first preferred embodiment of the improved vehicle speed bump device of the present invention, shown disposed in a roadway.
Figure 2:
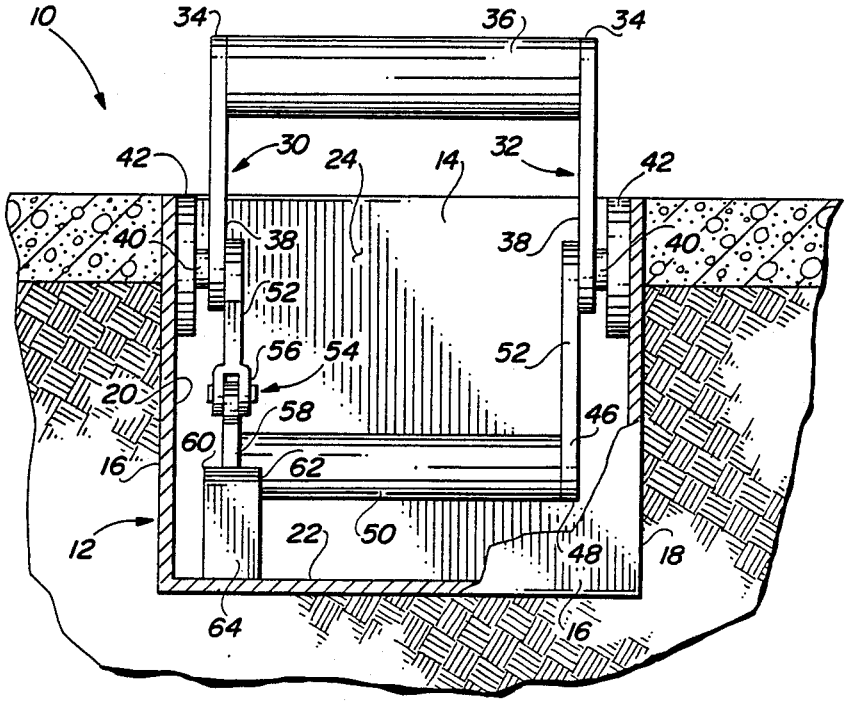
FIG. 2 is a schematic rear elevation of the device of FIG. 1.

A first preferred embodiment of the improved vehicle speed bump device of the present invention is schematically depicted in FIGS. 1 & 2. Thus, device 10 is shown, which comprises a rigid container 12 of metal, such as steel, or other durable material, having a front 14, a rear 16, opposed sidewalls 18 & 20 and a bottom 22, collectively defining a central space 24 and open top 26.

Device 10 further includes a preferably generally rectangular 28 of durable metal or the like comprising a first spaced pair of arms 30 & 32 which extend upwardly and are connected at their upper ends 34 to a transverse speed bump bar 36 and at their lower ends 38 to a pair of axles 40 rotatably secured in fittings 42 in the upper ends of sidewalls 18 & 20. Speed bump bar 36 can be covered with rubber or left uncovered as desired.

Frame 28 further includes a second spaced pair of arms 44 & 46 connected at their lower ends 48 to a transverse counterweight bar 50 of heavy metal or the like, such as steel, a lead-lined steel tube, etc., and connected at their upper ends 52 to axles 40. Frame 28 rotates forwardly and rearwardly in container 12 as a single rigid unit along with axles 40.

Arms 44 & 46 may be at a slight angle to arms 30 & 32, if desired, so that when frame 28 is in the resting position shown in FIG. 1, with bar 50 at its lowermost position, bump bar 36 and arms 30 & 32 are not in a vertical alignment, but are sloped toward rear 16. This is desired so that when bump bar 36 is contacted from in front thereof, by the wheel of a vehicle traveling toward rear 16, bar 36 will tend to rotate downwardly and rearwardly immediately and smoothly.

Device 10 also includes a frame lock 54 of steel or other metal or other durable material which comprises a lock arm 56 rigidly secured to one of the axles 40 or to frame 28 at about the location of axle 40 and extends rearwardly therefrom in container 12, preferably at an angle of about 90° to arms 30 & 32. A pendulum arm 58 is secured to the rear end of arm 56 for free forward and rearward rotation, and bears at its lower end a generally triangular friction block 60 having a rearwardly directed friction face 62. A second triangular friction block 64 having a forwardly directed friction face 66 is rigidly mounted in container 12 behind and below block 60. Faces 62 & 66 oppose each other.

The operation of device 10 will be best understood from the description set forth below for the device of FIGS. 3–8.

FIGS. 3–8.

FIGS. 3–8 schematically depict a slightly modified embodiment of the improved vehicle speed bump device of the present invention. Thus, device **10*a* is shown. Components thereof similar to those of device 10** bear the same numerals, but are succeeded by the letter "a".

Device **10*a* is substantially identical to device 10, differing therefrom only in the spacing and size, but not the nature of the components shown therein. The operation of device 10*a* is identical to that of device 10** so that the following description applies equally to both devices.

Figure 3:
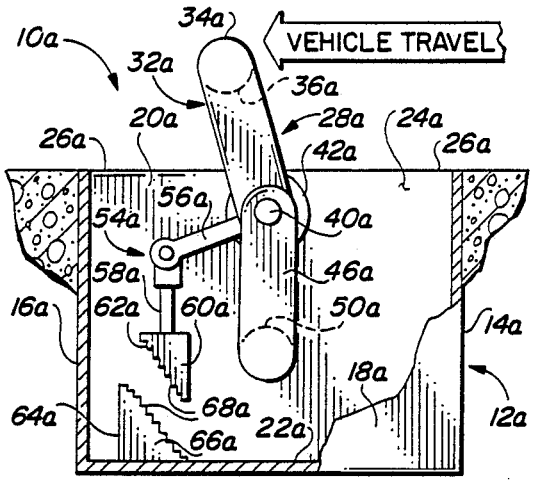
FIG. 3 is a schematic side elevation, partly broken away, of a second preferred embodiment of the device of the present invention, with the speed bump bar thereof shown in the resting raised position.
Figure 4:
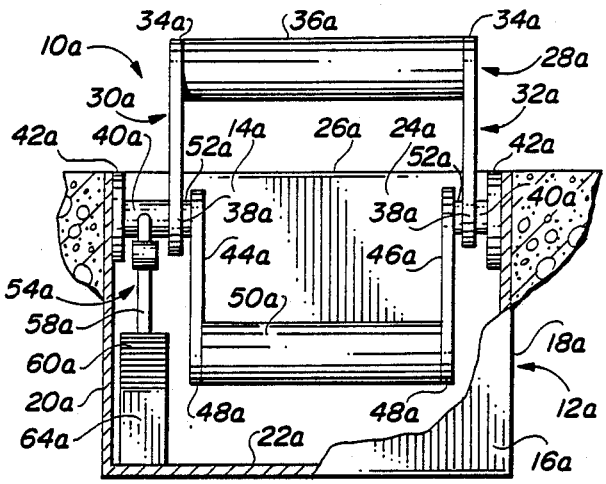
FIG. 4 is a schematic rear elevation, partly broken away, of the device of FIG. 3.

In FIGS. 3 & 4, device **10*a* is shown in the bump bar-up resting position. Thus, bar 36*a* is up above container 12*a* but sloped somewhat rearwardly and counterweight bar 50*a* is in the lowermost position holding bar 36*a* in the described position. Arm 56*a* preferably is in about 8 o'clock position, while pendulum arm 58*a* is vertical. Block 60*a* is above and in front of block 64*a***.

When a vehicle moves slowly from front **14*a* to rear 16*a* of container 12*a* and its wheel (tire) strikes bump bar 36*a*, frame 28*a* rotates counterclockwise (with respect to FIG. 3) and bar 36*a* moves rearwardly and downwardly smoothly until it is below top 26*a*; that is, is in the position of FIGS. 5 & 6, so that the vehicle encounters no resistance and no bump, but proceeds smoothly on its way. After such an encounter, counterweight bar 50*a* causes frame 28*a* to rotate clockwise (with respect to FIG. 5) to bring bar 36*a* back to the resting operative position of FIG. 3. In both instances, block 60*a* does not engage block 64*a***.

Figure 5:
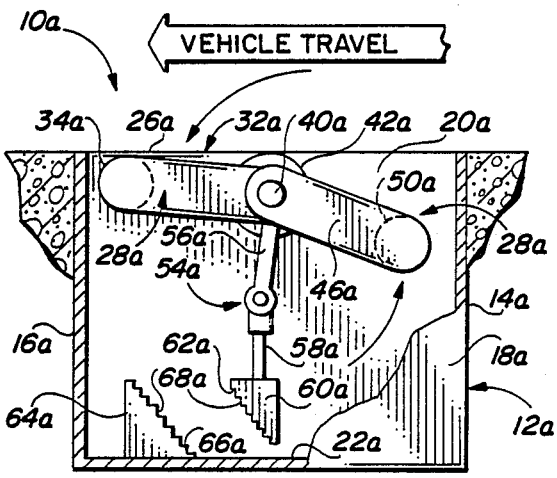
FIG. 5 is a schematic side elevation, partly broken away, of the device of FIG. 3, shown after rotation of the speed bump bar thereof to the down position following contact with a slow moving vehicle wheel.
Figure 6:
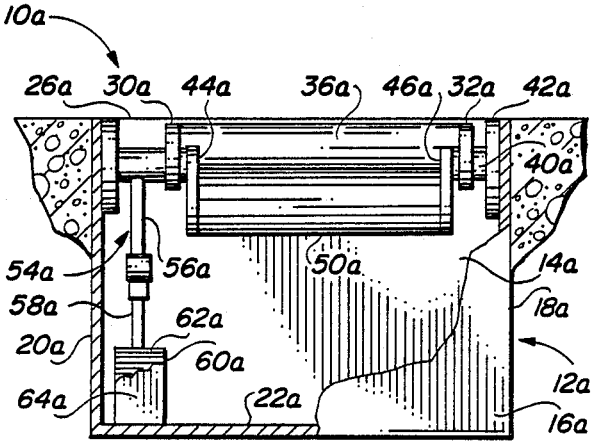
FIG. 6 is a schematic rear elevation, partly broken away, of the device of FIG. 3, in the position of FIG. 5.
Figure 7:
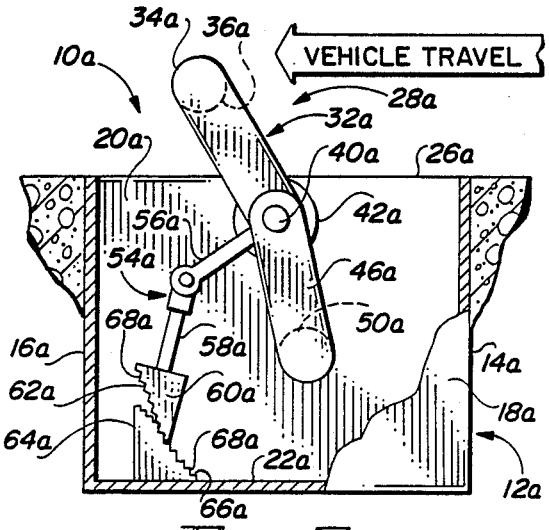
FIG. 7 is a schematic side elevation, partly broken away, of the device of FIG. 3, shown in the locked position after contact with a rapidly moving vehicle wheel; and, FIG. 8 is a schematic rear elevation, partly broken away, of the device of FIG. 3, shown in the position of FIG. 7.
Figure 8:
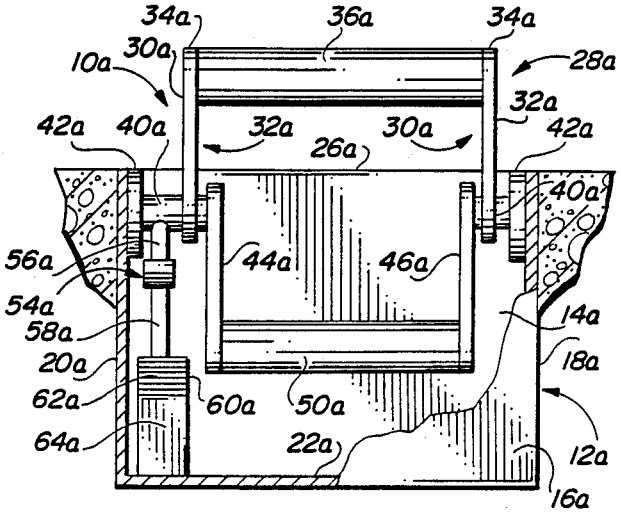

However, when a vehicle moves rapidly from front **14*a* to rear 16*a* of container 12*a*, lock 54*a* goes into operation to prevent frame 28*a* from rotating bar 36*a* completely to the down position of FIG. 5. Instead, the rapid momentum imported to frame 28*a* and arm 56*a* is translated to pendulum arm 58*a* which tends to straighten towards rear 16*a*, moving block 60*a* with it and locking it against block 64*a* as frame 28*a* rotates arm 56*a* downwardly. Faces 62*a* and 66*a* grip each other through mating lands and grooves 68*a*, as shown in FIGS. 7 & 8. This prevents frame 28*a* from rotating counterclockwise far enough to move bar 36*a* below top 26*a*. Frame 28*a* is frozen in position. Accordingly, the rapidly moving vehicle wheel bumps over locked frame 28*a*'s bar 36*a* to signal that such speed is excessive. Once the vehicle passes over container 12*a*, counterweight bar 50*a* again rotates frame 28*a* clockwise to the resting position of FIGS. 1 & 2, blocks 60*a* and 64*a*** readily disengaging from each other.

Accordingly, the automatic locking feature of device **10*a* operates without hydraulic or electric power and without the need for repair and adjustment. Slow moving vehicles are not bumped at all by device 10*a*. However, rapidly moving vehicles experience a large bump. It will be understood that block 64*a* can be repositioned relative to block 60*a* to control how much vehicle speed is required to cause lock 54*a* to operate. The closer that block 64*a* is to the normal path of block 60*a*, the lower the vehicle speed need be to cause lock 54*a* to operate. Thus, block 64*a* can be releasably and adjustably secured to bottom 22*a***, if desired, for the desired described speed adjusting purpose.

Various other features of the improved vehicle speed bump device are as set forth in the foregoing. Various modifications, changes, alterations and additions can be made in the improved device, its components and parameters. All such changes, modifications, alterations and additions as are within the scope of the appended claims form part of the present invention.

What is claimed is:

1. An improved vehicle speed bump device, said device comprising, in combination:

(a) a container having an interconnected bottom, front, rear and opposite sides, collectively defining a central space and an open top;

(b) a frame in said space comprising, i. a normally upwardly extending spaced first pair of arms rigidly interconnected at the upper ends thereof to a transverse speed bump bar; and, ii. a normally downwardly extending spaced second pair of arms rigidly interconnected at the lower ends thereof to a transverse counterweight bar;

(c) axle means rotatably connected to the inner surfaces of opposite sides of said container and interconnecting the lower ends of said first pair of arms and the upper ends of said second pair of arms for rotation of said frame as a rigid unit around said axle means forwardly and rearwardly relative to said container, said speed bump bar in the resting position projecting above the top of said container; and, (d) bump rotation lock means comprising, i. a lock arm rigidly connected to at least one of said axle and frame adjacent said axle for rotation therewith, said lock arm projecting rearwardly at an angle from said frame arms, ii. a vertical pendulum arm connected to the free end of said lock arm for free rotation forwardly and rearwardly in said container, said pendulum arm bearing at the lower end thereof a first friction block; and, iii. a second friction block mounted in a location below and to the rear of said first friction block, which location is adjacent to but out of the path of said first friction block during slow rotation of said frame to a bump bar position below said container top, as a result of slow contact of said bump bar by a vehicle wheel traveling over said container from the front to the rear thereof, but which is in the path of travel of said first friction block during rapid rotation of said frame, as a result of contact of said bump bar by such a vehicle wheel traveling rapidly, said first friction block being swung rearwardly by said rapid contact so that said two friction blocks lock together and prevent said arms and frame from rotating, thereby leaving said bump bar above said container top for bump contact with said vehicle wheel.

2. The improved speed bump device of claim 1 wherein said container is adapted to be set into a roadway, with the upper end thereof at roadway surface level, and wherein said first pair of frame arms are at an angle to said second pair of arms, so that when said counterweight bar is at its resting position, said bump bar and first pair of frame arms are slanted rearwardly to facilitate smooth contact with a vehicle wheel.

3. The improved speed bump device of claim 1 wherein said axle means comprises a pair of axles rotatably mounted in fixed fittings adjacent to the upper end of said container.

4. The improved speed bump device of claim 1 wherein said lock arm is disposed at about a right angle to said first pair of frame arms.

5. The improved speed bump device of claim 1 wherein said friction blocks are generally triangular, with opposing mating friction faces.

6. The improved speed bump device of claim 5 wherein said friction faces are grooved metal and wherein said frame, container and lock arm and pendulum arm are also metal.

7. An improved vehicle speed bump device, said device comprising, in combination:

(a) an open topped container;

(b) a frame mounted for rotation in said container, said frame bearing at the upper end thereof a bump bar and at the lower end thereof a counterweight; and (c) a rotation lock comprising a lock arm interconnected to said frame for rotation therewith and projecting rearwardly thereof, a pendulum arm connected to said lock arm for rotation forwardly and rearwardly and bearing a first friction block at its lower end, and a second friction block mounted in said container below and to the rear of said first friction block and contacted thereby only when said bump bar is struck with sufficient speed and force by a vehicle wheel to cause said first friction block to swing into the path of said second friction block, to lock said frame against rotation.

8. The improved speed bump device of claim 7 wherein said frame is secured to transversely extending axles in said container and is generally rectangular, with said bump bar projecting in the resting position above the top of said container.

9. The improved speed bump device of claim 7 wherein said lock arm is generally perpendicular to said frame and wherein said friction blocks are generally triangular with opposing mating friction faces.

10. An improved vehicle speed bump device adapted to be inbedded in a roadway, said device comprising, (a) an actuating member extending above the roadway for contacting vehicle tires, and (b) inertia locking means connected to said actuating member and responsive to the rate of movement of said actuating member to selectively allow either free movement of said actuating member or to reduce the rate of movement of said actuating member.

11. The improved speed bump of claim 11 wherein said movement is rotational.

* * * * *